United States Patent [19]

Hagiwara et al.

[11] Patent Number: 4,562,972

[45] Date of Patent: Jan. 7, 1986

[54] MICROPULVERIZER

[75] Inventors: Tatsuo Hagiwara, Funabashi; Shozi Nagano, Chiba, both of Japan

[73] Assignee: Kawasaki Jukogyo Kabushiki Kaisha, Hyogo, Japan

[21] Appl. No.: 598,453

[22] Filed: Apr. 9, 1984

[30] Foreign Application Priority Data

| | | | |
|---|---|---|---|
| Apr. 13, 1983 | [JP] | Japan | 58-64803 |
| Apr. 19, 1983 | [JP] | Japan | 58-68805 |
| Apr. 19, 1983 | [JP] | Japan | 58-68806 |
| Apr. 22, 1983 | [JP] | Japan | 58-71263 |
| Apr. 28, 1983 | [JP] | Japan | 58-75329 |

[51] Int. Cl.[4] ..... B02C 23/38

[52] U.S. Cl. ..... 241/260; 241/43; 241/47; 241/65; 241/79; 241/162

[58] Field of Search ..... 241/39, 47, 40, 43, 241/52, 53, 56, 58, 66, 80, 157, 162, 260, 261.1, 275, 79, 65

[56] References Cited

U.S. PATENT DOCUMENTS

| | | | |
|---|---|---|---|
| 46,627 | 3/1865 | Baugh | 241/261.1 |
| 1,048,869 | 12/1912 | Pitcairn | 241/43 |
| 2,092,307 | 9/1937 | Gaffney | 241/56 X |
| 2,362,142 | 11/1944 | Lykken et al. | 241/56 X |
| 2,561,388 | 7/1951 | Lykken et al. | 241/56 X |
| 3,229,698 | 1/1966 | Johansson et al. | 241/43 X |
| 3,777,993 | 12/1973 | Crandall | 241/162 X |
| 4,061,274 | 12/1977 | Williams | 241/52 X |

FOREIGN PATENT DOCUMENTS

| | | | |
|---|---|---|---|
| 754724 | 8/1956 | United Kingdom | 241/58 |
| 1265735 | 3/1972 | United Kingdom | 241/65 |
| 1594692 | 8/1981 | United Kingdom | 241/39 |

*Primary Examiner*—Howard N. Goldberg
*Assistant Examiner*—Joseph M. Gorski
*Attorney, Agent, or Firm*—Wenderoth, Lind & Ponack

[57] ABSTRACT

In a pulverizer of the type having, within a casing, a stator and a rotor to be rotated in the stator, both having large numbers of mutually confronting ridges or teeth with a gap therebetween, the gap is 1 mm or less, and the ridges of the stator are of sawtooth shape as viewed in cross section and have flanks forming troughs therebetween with an acute bottom dihedral angle of 45 to 60 degrees. At least one tier of a classification ring is provided around the inner wall surface of the stator to form flow-blocking barriers across some or all of the troughs thereby to prevent particles being pulverized from being swept through the troughs without being satisfactorily pulverized.

15 Claims, 22 Drawing Figures

MICROPULVERIZER

BACKGROUND OF THE INVENTION

This invention relates generally to improvements in pulverizers or mills and more particularly to a micronization pulverizer capable of pulverizing particles to be pulverized into fine particles of sizes in the range of from micron order to a size between 10 and 20 microns.

A typical pulverizer known heretofore comprises essentially a cylindrical casing with a vertical axis having a material inlet at its bottom and a product outlet at its top, a cylindrical stator supported on the inner wall surface of the casing or formed integrally therewith, a rotor disposed coaxially within the stator, a vertical rotating shaft rotatably supported by the casing and fixedly and coaxially supporting the rotor, and motive power means for driving the shaft and the rotor in rotation. The outer surface of the rotor and the inner surface of the stator are respectively provided with mutually confronting ridges interspersed with alternately interposed troughs, the ridges and troughs extending in the direction of the generatrices of the rotor and the stator and having rectangular shapes in cross section.

In the operation of the known pulverizer of the above described general construction, as the rotor is rotated at high speed and suction is applied to the product outlet, the particulate material to be pulverized is fed and swept into the material inlet by air aspirated by the suction and, as it is wafted upward between the rotor and the stator by the upward air stream, is pulverized by a number of pulverizing actions between the material and the rotor and the stator as described more fully hereinafter.

In this known pulverizer, a wide gap of the order of from 2 to 5 mm; or even more, is provided between the ridges of the rotor and those of the stator. Such a wide gap becomes the cause of such shortcomings as weak vortices in the troughs between the ridges, low probability of the particles being struck by the rotor, and small force with which the particles are struck by the rotor, all of which are causes of poor pulverization performance. Still another problem encountered in the prior pulverizer is that, because of the nature of the upward passage of the particles through the pulverization chamber between the rotor and the stator, some of the particles pass through the pulverization chamber without being satisfactorily pulverized. As a consequence, the product obtained comprises particles of sizes in a wide range with an average particle size of the order of 40 to 60 microns.

SUMMARY OF THE INVENTION

The above described problems encountered in the known pulverizer, as discussed in greater detail hereinafter, have been overcome in the pulverizer according to this invention, by which pulverized products of particles of sizes of narrow range of from micron order to 20 microns can be obtained.

According to this invention in a basic aspect thereof, briefly summarized, there is provided a micronization pulverizer (hereinafter called a "micropulverizer") having a casing having at the bottom thereof a feed inlet for particles to be pulverized and air conveying the particles and having at the top thereof a pulverized product discharge outlet, a rotor supported within the casing by a vertical rotating shaft and having along generatrices on the outer surface thereof a large number of ridges, and a stator provided around the inner wall surface of the casing and having along generatrices on the inner wall surface thereof a large number of ridges confronting the ridges of the rotor with a gap therebetween, this micropulverizer being characterized in that: said gap is 1 mm or less; the ridges of the stator are of sawtooth shape as viewed in cross section, each ridge having leading and trailing flanks with respect to the relative movement between the rotor and the stator, the trailing flank lying in a plane passing substantially through the stator axis and forming an acute dihedral angle ($\alpha$) of 45 to 60 degrees with the opposite leading flank of the adjacently following ridge, thereby defining a trough therebetween of triangular cross section, the leading flank lying in a plane substantially tangential to the outer surface of the rotor; and at least one tier of a classification ring provided around the inner wall surface of the stator to form flow-blocking barriers across some or all of the troughs.

According to this invention in other aspects thereof, there are provided improvements in and relating to the basic micropulveriser as defined above, as will be described in detail hereinafter.

The nature, utility, and further features of this invention will be more clearly apparent from the following detailed description with respect to preferred embodiments of the invention when read in conjunction with the accompanying drawings, briefly described below.

DETAILED DESCRIPTION OF THE INVENTION

Figure 1:
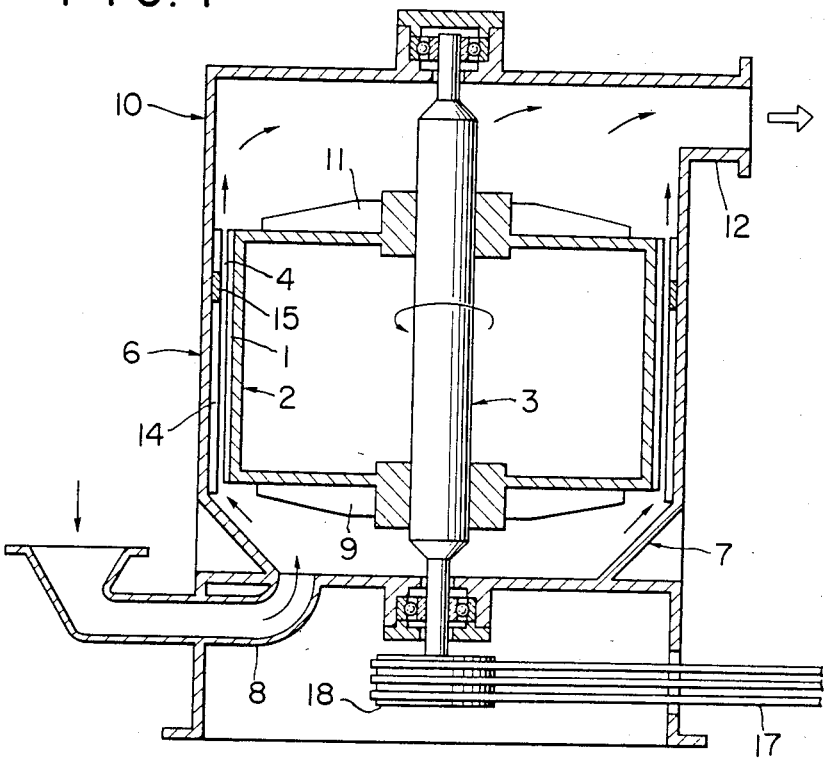
FIG. 1 is an elevation, with parts shown in vertical section, showing the essential parts of a basic example of the micropulverizer according to this invention.

As conducive to a full understanding of this invention, the general nature and limitations of a conventional pulverizer, as briefly mentioned hereinbefore, will first be described with reference to FIGS. 19, 20, 21, and 22.

The essential parts of the known pulverizer are: a cylindrical rotor 2 coaxially supported on a vertical rotating spindle or shaft 3 and having around its outer surface a large number of outwardly directed ridges 1 extending along generatrices of the cylindrical surface; a cylindrical stator 6 disposed coaxially around the rotor 2 with a gap 4 therebetween and having around its inner surface a large number of inwardly directed ridges 5 extending along generatrices of the cylindrical inner surface; a casing comprising a cylindrical upper part 10, the lower part of which constitutes the stator 6, and a lower part 7 of inverted frustoconical shape and rotatably supporting at its ceiling and floor the upper and lower ends of the rotor shaft 3; and motive power means for rotating the shaft 3 at high speed.

The casing further has a product discharge outlet 12 directed horizontally and tangentially to the top peripheral part of the upper part 10 of the casing and a feed inlet 8 connected from below to the floor at a part thereof near the lower part 7 of the casing. The outlet 12 is connected to an exhaust fan (not shown). Agitation vanes 9 are fixed to the lower surface of the rotor 2 and rotate unitarily therewith. Centrifugal vanes 11 are similarly fixed to the upper surface of the rotor 2.

When the exhaust fan is operated and the material to be pulverized is fed into the feed inlet 8, the material is sucked together with air into the interior of the lower part 7 of the casing, where the material is swept radially outward by the air current caused by the agitation vanes 9 and rises along the frustoconical wall of the lower part 7 of the casing to enter the pulverization chamber formed between the rotor 2 and the stator 6. Because of the high speed of rotation of the rotor 2, the material receives kinetic energy and, thereby colliding with the stator 6, is pulverized. At the same time, the material is pulverized by the striking action of the ridges 1 of the rotor 2 and is pulverized further to a finer size by the rubbing action between the ridges 1 of the rotor 2 and the ridges 5 of the stator 6.

At the same time, the material thus being pulverized is progressively carried upward by a rising helical air current created by the high-speed rotation of the rotor 2 and the above mentioned suction of the exhaust fan and enters the space within the upper part 10 of the casing above the rotor 2. The pulverized material is then caused by the centrifugal vanes 11 to rotate along the inner wall surface of the upper casing part 10 and is discharged through the product discharge outlet 12.

The product thus discharged is introduced into a bag filter (not shown), where the pulverized product is separated from the air, which is discharged via the exhaust fan. The product thus separated is transferred from the bag filter, through a hopper, and into a storage vessel (not shown).

Figure 21:
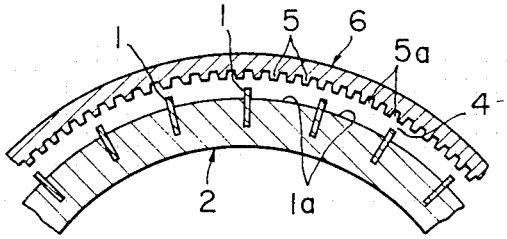
FIG. 21 PRIOR ART

It should be mentioned that, in some known pulverizers, the rotor 2 has a cross-sectional shape as shown in FIG. 21. In this case the ridges 1 are formed by partially imbedding flat plates in the outer cylindrical surface of the rotor 2.

In the known pulverizer as described above, the gap 4 between the rotor 2 and the stator 6, in general, is wide, being 2 to 5 mm or even more. Such a wide gap gives rise to shortcomings such as the following.

(a) The vortices generated in the troughs between adjacent ridges 5 of the stator are weak.

(b) The probability of the particles of the material being pulverized being struck by the rotor 2 is low.

(c) The force with which the particles of the material being pulverized are struck by the rotor 2 is small.

Figure 22:
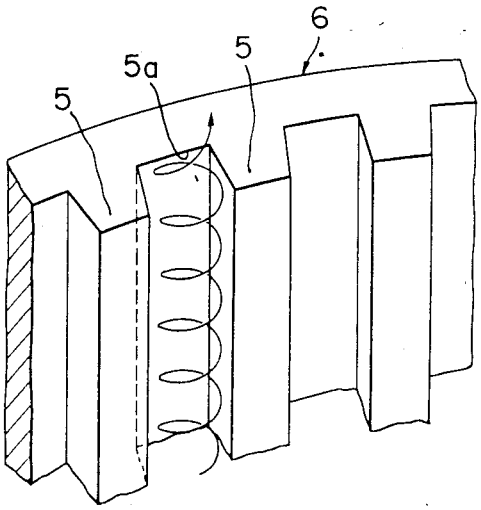
FIG. 22 PRIOR ART
FIG. 22 is a fragmentary perspective view indicating the manner in which particles are wafted upward by a helically whirling current of air in the troughs of the stator in the known pulverizer illustrated in FIGS. 19, 20, and 21.

Furthermore, in the pulverization chamber formed by the rotor 2 and the stator 6, the air is to pass through the troughs 1*a* of the rotor 2, the gap 4, and the troughs 5*a* of the stator 6, and the particles of the material being pulverized are wafted on this air, that is, the upward helical air stream, and pass through the pulverization chamber. However, since the rotor 2 is rotating at a high speed, almost none of the particles being pulverized passes through the troughs 1*a* of the rotor. Consequently, most of the particles being pulverized pass through only the gap 4 and the troughs 5*a* of the stator 6. Then, since the cross-sectional shapes of the ridges 5 and the troughs 5*a* of the stator 6 are close to rectangles, the air flows upward along the troughs 5*a* of the stator 6 as it forms vortices therein of high rotational velocity as indicated in FIG. 22.

Of the particles swept into these vortices, some collide against the wall surfaces of the troughs 5*a* and, further, are discharged from the troughs 5a into the gap 4, being then subjected to a powerful striking action by the ridges 1 of the rotor 2 and to pulverization by a rubbing action against the ridges 5 of the stator 6. However, some of the particles of the material are not pulverized in the above described manner but, in their state of being swept upward in the vortices in the troughs 5a, leave the pulverization chamber from the upper ends of the troughs 5a. This has been a drawback of the above described known pulverizer.

Consequently, the average particle size of the product pulverized by a pulverizer of this character is of the order of, for example, 60 μm in the case of polished rice and 40 μm in the case of toner, which cannot be said to be an ample degree of pulverization. Thus, pulverized products of sizes of micron order to twenty microns cannot be obtained by the use of a conventional pulverizer as described above.

The above described problems accompanying the conventional pulverizer have been solved by this invention, which will now be described in greater detail.

As shown in FIG. 1, the general construction of the micropulverizer of this invention is essentially similar to that of conventional pulverizer described hereinabove. Those parts of this micropulverizer which are the same as or equivalent to corresponding parts of the known pulverizer described hereinabove are designated by the same reference numbers. The micropulverizer comprises a casing 7, 10 having at the bottom thereof a feed inlet 8 for particles to be pulverized and air conveying the particles and having at the top thereof a pulverized product discharge outlet 12, a rotor 2 supported within the casing by a vertical rotating shaft 3 and having along generatrices on the outer surface thereof a large number of ridges 1, and a stator 6 provided around the inner wall surface of the casing and having along generatrices on the inner wall surface thereof a large number of ridges 14 confronting the ridges 1 of the rotor 2 with a gap 4 therebetween.

Figure 2:
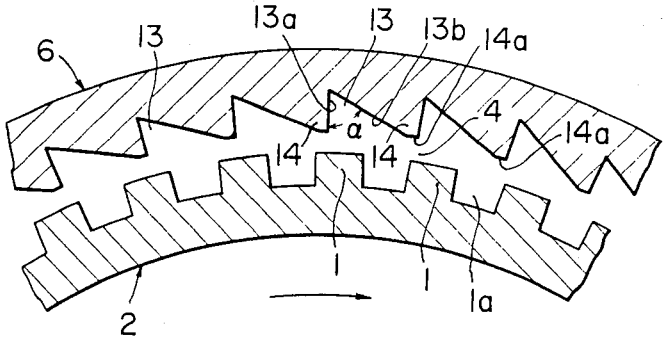
FIG. 2 is an enlarged, fragmentary plan view, in horizontal cross section, showing ridges and troughs respectively of the rotor and stator of the micropulverizer shown in FIG. 1.

In this micropulverizer, the gap 4 between the rotor 2 and the stator 6 is made less than 1 mm. As most clearly shown in FIG. 2, the stator 6 is provided around its inner surface with Vee-shaped valleys or troughs 13 formed between ridges 14, which are of sawtooth shape as viewed in cross section as shown. Each ridge 14 has a short flank 13a and a longer flank 13b, which are respectively trailing and leading flanks with respect to the relative movement between the rotor 2 and the stator 6. The short flank 13a lies in a plane passing substantially through the rotational axis of the stator 6 and is at an acute dihedral angle $\alpha$ of 45 to 60 degrees relative to the opposite longer leading flank 13b of the adjacently following ridge. Each longer leading flank 13b lies in a plane substantially tangential to the cylindrical surface in which the bottoms of the troughs 1a of the rotor 2 lie. The trailing flank 13a has a height in the radial direction of the stator 6 of the order of 1 to 5 mm.

A concave arcuate surface 14a lying in a circle the center of which is coincident with the centerline of the stator 6 is formed at the extreme tip of each ridge 14. The width of this arcuate surface 14a as viewed in cross section is of the order of 1 mm.

Figure 3:
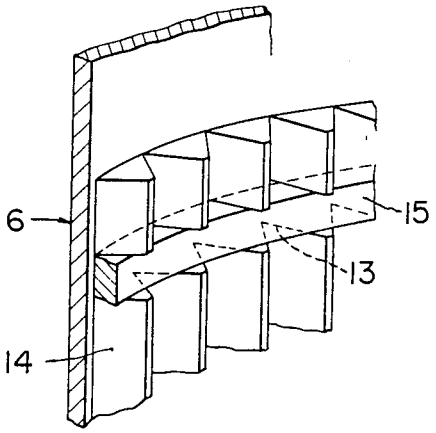
FIG. 3 is a fragmentary perspective view, with a part shown in section, showing a classification ring installed at an intermediate part of troughs between ridges of the stator.
Figure 4:
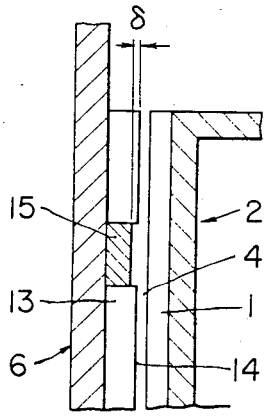
FIG. 4 is a fragmentary elevation, in vertical section, showing the relationships between the rotor, the stator, their ridges, and the classification ring.

As shown in FIGS. 3 and 4, the stator 6 is provided circumferentially around its inner wall surface at an intermediate height part thereof with a particle classification ring 15 constituting a full or partial barrier in the troughs 13. This ring 15 is formed integrally with the stator 6 or is detachably secured thereto. Since this ring 15 may constitute a full barrier in the troughs 13, the difference $\delta$ between its height or dimension in the stator radial direction and the height of the ridges 14 may be zero. In the case where this classification ring 15 is detachably secured to the stator 6, it is divided into a plurality of parts in the circumferential direction. While, in the illustrated example, only a single classification ring 15 is provided, the number of classification rings is not so limited but may be plural, the plurality of rings being at spaced-apart vertical positions. Furthermore, the classification ring 15 may be divided into a plurality of arcuate sections and secured to the stator 6 at different staggered levels thereof.

The other parts and their construction of the micropulverizer according to this invention are the same as those in the known pulverizer described hereinbefore, and therefore detailed description thereof will not be repeated.

The micropulverizer of the above described structural organization according to this invention operates in the following manner. Referring again to FIG. 1, when the exhaust or suction fan (not shown) connected to the product discharge outlet 12 and the motive power means (also not shown) for driving the shaft 3 are operated, the rotor 2 is rotated through belts 17 and a pulley 18 on the shaft 3 and, particles of the material to be pulverized fed through the feed inlet 8 connected to the bottom of the casing are sucked together with air into the lower part 7 of the casing and are caused to rise along the inclined inner surface of the lower casing part 7 by the air current caused by the agitation vanes 9 rotating at high speed unitarily with the rotor 2, being sent into the pulverization chamber formed between the rotor 2 and the stator 6. All of the particles thus fed are thereupon subjected to micropulverization action and, becoming a micropulverized product of a narrow range of particle size of from micron order to a size between 10 and 20 microns, are sent into the upper part 10 of the casing.

In the upper casing part 10, the particles are caused to rotate along the inner peripheral surface thereof by the action of the centrifugal vanes 11 rotating at high speed unitarily with the rotor 2 to be discharged through the product discharge outlet 12 and are introduced into a bag filter (not shown), which functions to separate the micropulverized product and the air as in the known pulverizer described hereinbefore.

The action of micropulvering the particles of the material to be pulverized in the pulverization chamber will now be described in detail by considering the interrelationship between the rotor 2, the stator 6, and the classification ring 15.

Figure 5:
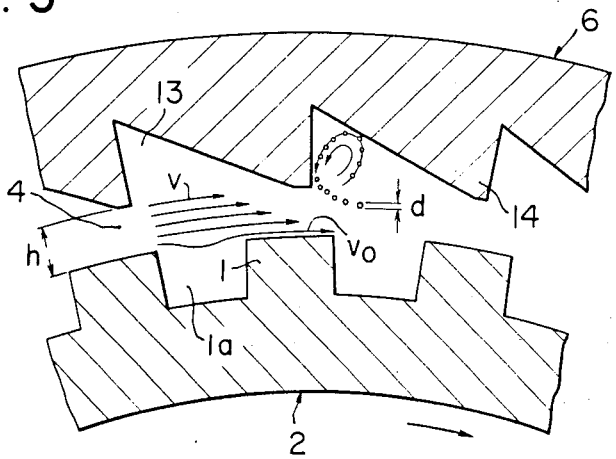
FIG. 5 is a further enlarged, fragmentary plan view, in horizontal cross section, indicating the flow of air and particles in the troughs of the stator and in the gap between the rotor and the stator.

In general, the nature of air around a rotating body is such that the air adhering to the surface of the body rotates at the same velocity as the peripheral velocity of the rotating body, while the velocity of the air at positions separated from the body surface decreases from the peripheral velocity with increase in the distance of separation from the body surface. Then, when the troughs 13 of the stator 6 in the micropulverizer of this invention are considered, it is found that a vortex is induced in each trough 13 as indicated in FIG. 5. It is also found that the rotational velocity of the vortex is proportional to the circumferential velocity v of the air flowing along the surface of the openings of the troughs 13.

Accordingly, the greater is the dimension h of the gap 4 between the rotor 2 and the stator 6, the greater is the departure in the decreasing direction of the above mentioned circumferential velocity v from the peripheral velocity of the rotor 2, and the lower is the rotational velocity of the vortices. Conversely, the smaller the dimension h of the gap 4, the higher is the rotational velocity of the vortices. Consequently, the particles being pulverized which have been swept into the vortices collide with greater impact against the wall surfaces as the rotational velocity of the vortices increases. Furthermore, the higher the rotational velocity of the vortices, the smaller are the particle sizes of the particles also colliding with the wall surfaces, whereby the particles fed into this micropulverizer are finely pulverized.

In another aspect of the pulverization mechanism, the probability P of the particles which have moved out of the vortices within the troughs 13 into the gap 4 being struck by the ridges 1 of the rotor 2 can be expressed by the equation $P \propto (d/h) \times n$, where: h is the dimension of the gap 4; d is the particle diameter of the particles; and n is the number of the ridges 1 on the rotor 2. The micropulverizer of this invention in which the dimension h of the gap 4 is small and the number of the ridges 1 is large has a large value of the striking probability P, whereby the pulverization action of the rotor 2 striking the particles is carried out efficiently.

Furthermore, the particles which have moved out of the troughs 13 of the stator 6 into the gap 4 are accelerated by the air stream flowing through the gap 4. In this case, the greater the dimension h of the gap 4, the longer becomes the time until the particles are struck by the ridges 1 of the rotor 2. For this reason, the relative velocity between the particles and the rotor 2 at the time of striking becomes low, the impact force with which the particles are struck by the rotor 2 becomes small. However, since the dimension h is very small, being 1 mm or less, in the micropulverizer of this invention, the time up to the instant the particles are struck by the rotor 2 is short. As a result, the relative velocity between the particles and the rotor 2 at the time of striking becomes high, and the striking impact force with which the rotor 2 strikes the particles becomes great. Therefore, the particles are positively struck and pulverized.

The flow of air and particles in the troughs 13 and the pulverization mechanism will now be considered in further detail. Because of the triangular shape of the troughs as described hereinbefore, the flow of the air in each trough 13 assumes two separate forms indicated by a, a', a'', . . . and a vortex b, b', b'', . . . in FIG. 6. The particles swept into the vortex b, b', b'', . . . collide against the wall surfaces 13*a* and 13*b* and undergo pulverization similarly as in the case of the aforedescribed trough 5*a* of the conventional rectangular shape. These particles, riding on the eddy air current, move along the trailing flank wall 13*a* and advance to the extreme tip of the ridge 14 from which they enter the gap 4. In this gap 4, these particles are struck by a ridge 1 of the rotor 2 and are thus further pulverized. The particles are then subjected to the same action by the succeeding trough 13 and ridge 1, and thus the pulverization successively proceeds.

On the other hand, the particles swept along by the air current a, a', a'', . . . , which almost never occurs in the case of the conventional trough 5*a* of rectangular shape, advance along the leading flank wall 13*b* to the extreme tip A of ridge 14 and enter the gap 4, where they are struck and pulverized by a ridge 1 of the rotor 2. At the same time, the particles thus struck and pulverized are further forced to collide against the succeeding leading flank wall 13*b* and are thus further pulverized. Then the same action occurs at the succeeding trough 13, and pulverization successively proceedss. As a result, in comparison with the case of the conventional trough 5*a* of rectangular shape, the striking action by the rotor 2 occurs not only at the point B but also at the point A, whereby the pulverization probability is higher, and the particles are micropulverized to finer sizes and, moreover, with higher efficiency.

As described hereinbefore and as shown in FIGS. 3 and 4, the classification ring 15 which constitutes a partial or complete obstruction in the troughs 13 is provided around the inner wall surface of the stator 6 at an intermediate height level therefore. This classification ring 15 functions to prevent the particles being pulverized from being swept up by a helical vortex whirling at high velocity within the troughs 5 and thus leaving the pulverization chamber without being adequately pulverized as in a conventional pulverizer as indicated in FIG. 22. As a result, the residence or retention time of the particles in the pulverization chamber is prolonged by the classification action of the classification ring 15 as described hereinafter. At the same time the concentration of the particles in the pulverization chamber becomes high.

A long retention time of the particles means that the probability of their being subjected to effective pulverization action rises, whereby a finer pulverized product is obtained. A high particle concentration means a high probability of the particles colliding and rubbing against each other, whereby the pulverization action is aided. With these two actions, the micropulverization of the particles proceeds positively.

The particles pulverized in this manner are wafted by the air current and tend to move out into the gap 4 at a level immediately below the classification ring 15. However, since centrifugal force due to the rotation of the rotor 2 is still in effect here, particles that are of sizes greater than a certain size are forced back into the troughs 13 of the stator 6. The particles thus forced back are again subjected to pulverization and, until they are reduced to sizes below the above mentioned limiting size, cannot pass through the region below the classification ring 15. Thus pulverization is amply accomplished. The particles passing by the classification ring 15 are subjected to further pulverization in the pulverization chamber above the ring. As a result, the size distribution of the particles finally leaving the pulverization chamber is of narrow range.

The micropulverized particles which have thus passed through the pulverization chamber are found to be a micropulverized product of particle sizes from micron order to a size between 10 to 20 microns as a result of the synergistic effect of a gap 4 of less than 1 mm, a large number of triangular troughs 13 of the stator 6 each defined by ridge flanks 13*a* and 13*b* as described hereinbefore forming an acute dihedral angle of 45 to 60 degrees, and a classification ring 15.

Figure 6:
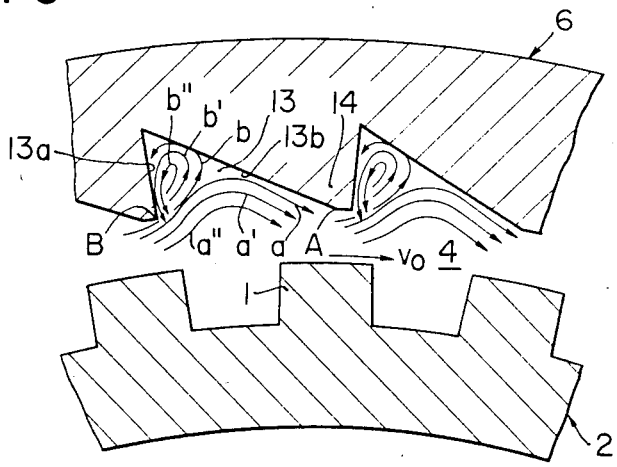
FIG. 6 is a view similar to FIG. 5 further indicating the flow of air and particles in the troughs of the stator and between the rotor and the stator.
Figure 7:
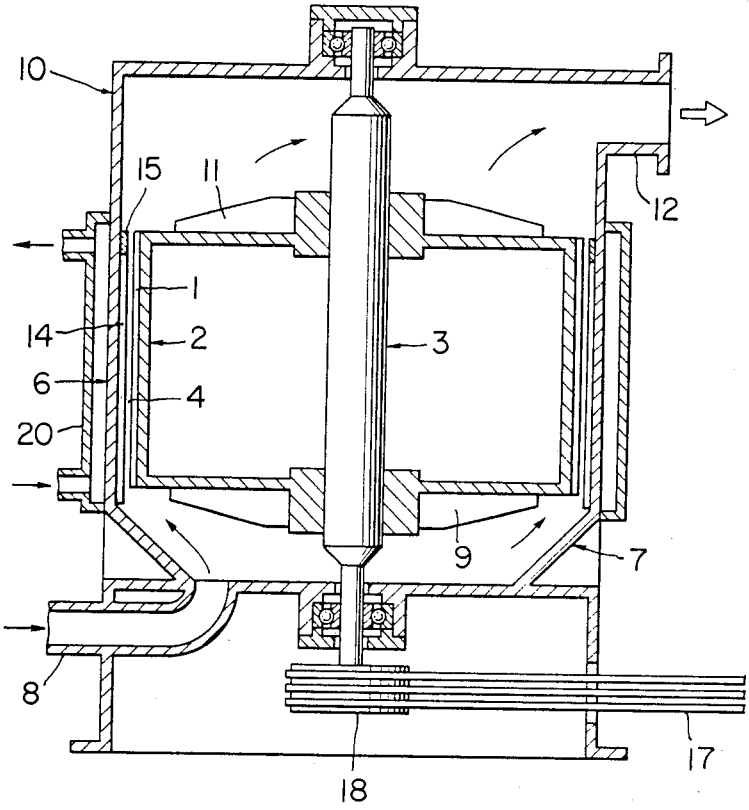
FIG. 7 is a view similar to FIG. 1 showing another example of the micropulverizer, in which a cooling jacket is provided around the stator part of the casing.
Figure 8:
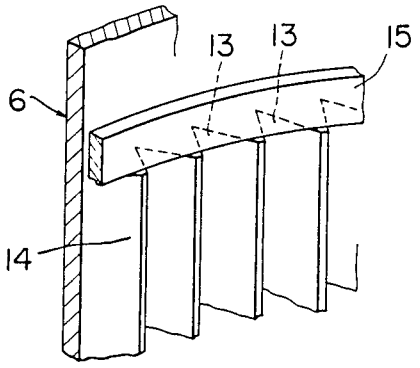
FIG. 8 is a perspective view similar to FIG. 3, showing the position of the classification ring in the micropulverizer shown in FIG. 7.
Figure 9:
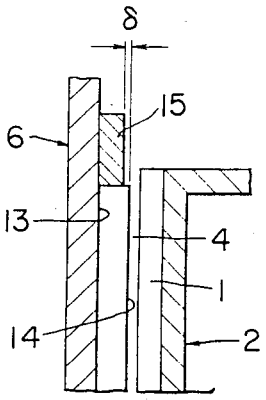
FIG. 9 is a view similar to FIG. 4 showing the relationships between the rotor, the stator, their ridges, and the classification ring in the micropulverizer shown in FIG. 7.

In another embodiment of this invention as illustrated in FIG. 7, the micropulverizer differs from that described above with reference to FIGS. 1 through 6 in that a cooling jacket 20 is provided around the casing in the region where the stator 6 is disposed, and in that the classification ring 15 is positioned to be contiguously above the extreme upper ends of the ridges 14 of the stator 6. The manner in which the classification ring 15 is mounted is indicated in detail in FIGS. 8 and 9.

In the conventional pulverizer, the air introduced together with the particles to be pulverized into the pulverizer has been cooled beforehand by an air cooler. However, while the temperature of the exhaust air can be held at a suitable value by such a cooling of the introduced air, rises in local temperatures of the stator 6 could not be suppressed. The cooling jacket 20 in this embodiment of the invention is effective in suppressing any rise in temperature of the stator 6.

Figure 10:
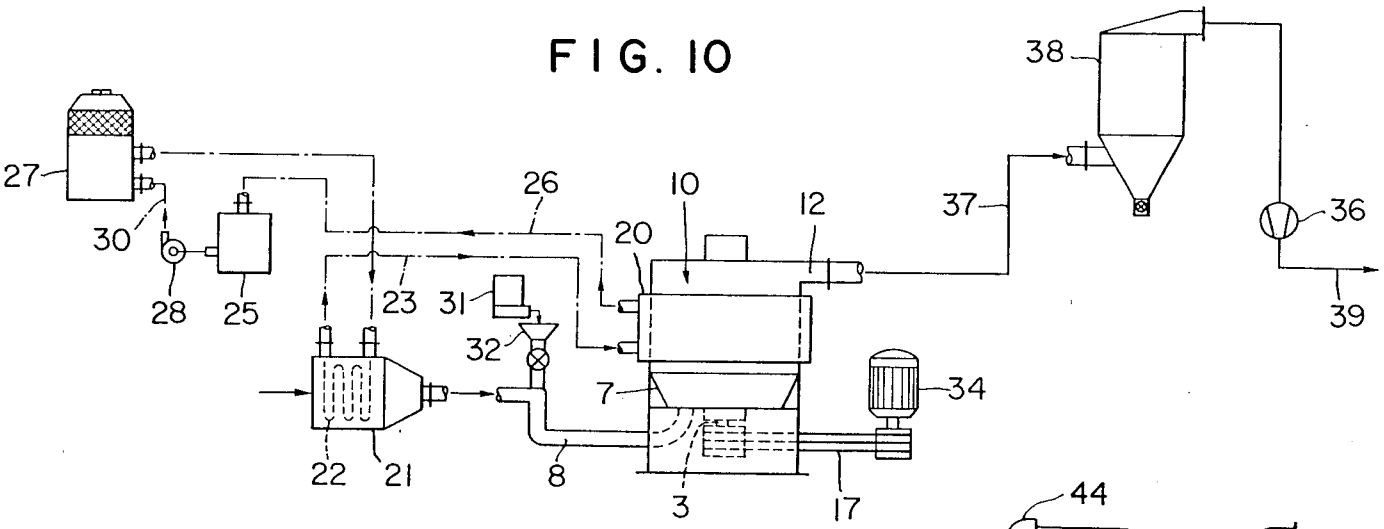
FIG. 10 is a schematic flow diagram showing the essential parts and organization of a pulverization apparatus comprising the micropulverizer shown in FIG. 7 as the principal component, a refrigeration system for supplying a refrigerant to the cooling jacket and an air cooler, motive power means for the micropulverizer, a bag filter, and an exhaust fan for drawing air through the micropulverizer and the bag filter.

As shown in FIG. 10, a cooling system is connected to the cooling jacket 20 to cool the stator 6 and to the feed inlet 8 to cool the air introduced together with particles of the material to be pulverized into the micropulverizer. More specifically, an air cooler 21 is connected to an air duct which is connected to the feed inlet 8 for supplying air thereinto. The air cooler 21 has a cooling coil 22 with an inlet and an outlet for a refrigerant. The cooling jacket 20 has at its lower and upper ends a refrigerant inlet and a refrigerant outlet. The outlet of the cooling coil 22 of the air cooler is connected by a pipe line 23 to the inlet of the cooling jacket 20. The outlet of the cooling jacket 20 is connected by a pipe line 26 to the inlet of a refrigerant tank 25. The outlet of the refrigerant tank 25 is connected by a pipe line 30 to the inlet of a refrigeration machine 27, a pump 28 being installed in the pipe line 30. The outlet of the refrigeration machine 27 is connected to the inlet of the cooling coil 22, whereby a closed refrigerant circuit is formed.

The material to be pulverized is fed by a feeder 31 into a particle material feed inlet 32 connected to the above mentioned air duct at a point thereof intermediate between the air cooler 21 and the feed inlet 8. The aforementioned motive power means for driving the rotor 2 is a motor 34 coupled to the rotor shaft 3 through an endless belt 17. The product discharge outlet 12 of the pulverizer casing is connected by a discharge duct 37 to the inlet of a bag filter 38, the outlet of which is connected to an exhaust (suction) fan 36, from which air is exhausted through an exhaust duct 39.

In the operation of this micropulverizer, the motor 34 is started to rotate the rotor 2 at high speed, and the exhaust fan 36 is operated. At the same time, the refrigeration machine 27 is operated to send the refrigerant at low temperature through the cooling coil 22 of the air cooler 21 thereby to cool the air to be supplied together with the particles to be pulverized into the feed inlet 8 to a temperature of 0° to 5° C. This cooled air picks up the particles fed through the above described feeder 31 into the particle material feed inlet 32 and enters the micropulverizer through the feed inlet 8. The particles thus fed are micropulverized as described hereinabove with respect to the preceding embodiment of the invention, the finely pulverized product being discharged out through the product outlet 12 and being separated from the air by the bag filter 38.

As a consequence of the pulverization of the particles in the above described micropulverizer, the air and the particles undergo a rise in temperature as they travel upward through the pulverization chamber. Theoretically, this temperature rise occurs at a uniform constant rate from bottom to top. In actual practice, however, local increases in the concentration of the particles in the gap 4 and the troughs 13 of the stator 6 cannot be avoided, whereby local rises in the temperature of the particles and the aspirated air occur.

According to the instant example of this invention, these local rises in temperature are suppressed not only by cooling the intake air by means of the air cooler 21 but also by passing the refrigerant leaving the cooling coil 22 of the air cooler 21 through the cooling jacket 20 thereby to bring about a heat exchange, through the wall of the stator 6, between the air and particles traveling through the gap 4 and the troughs 13 of the stator 6 and the refrigerant flowing through the cooling jacket 20. The total heat transfer coefficient in this heat exchange is large since the gap 4 is of very small dimension of below 1 mm, whereby the heat exchange efficiency is very good, and the cooling effectiveness is remarkably high. Thus, in comparison with the cooling system of the conventional pulverizer wherein only the aspirated air is cooled, not only a rise in temperature of the air and the particles but also local temperature rises in the stator 6 can be readily and positively suppressed.

Figure 11:
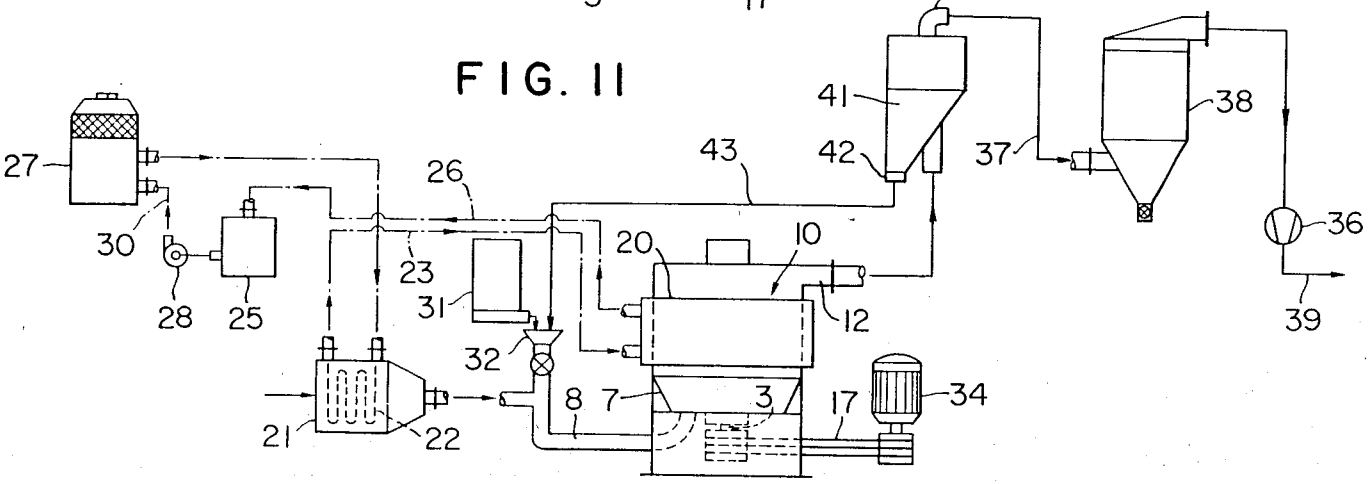
FIG. 11 is a schematic flow diagram showing a modification of the apparatus shown in FIG. 10.

The micropulverizer described above and illustrated in FIG. 10 can be modified as shown in FIG. 11. In this modified micropulverizer, a particle classifier 41 is installed at an intermediate point in the pipe line 37 connecting the product outlet 12 and the bag filter 38. This classifier 41 has a discharge outlet 44 and another discharge outlet 42 for coarse particles which is connected via a pipe line 43 to the aforementioned particle material feed inlet 32. In other respects, this example of the micropulverizer is the same as the preceding example.

In the operation of this modified micropulverizer, the particle product pulverized to a narrow range of particle size of from micron order to a size between 10 and 20 microns is discharged together with air through the product discharge outlet 12 and, entering the classifier 41, is classified into fine particles of micron order and relatively coarse particles of from 10 to 20 microns. The fine particles are discharged from the outlet 44 and pass through the pipe line 37 and are separated by the bag filter 38 from the air, which is drawn by the exhaust fan 36 and discharged through the discharge pipe 39. The fine particles thus separated are sent from the bag filter 38 to storage means (not shown).

On the other hand, the relatively coarse particles are discharged from the outlet 42 and pass through the pipe line 43 from the outlet 42 and enter the feed inlet 32, into which new particles to be pulverized are being fed from the feeder 31. The coarse particles and the new particles are together swept by the cooled air from the air cooler 21 and enter the micropulverizer, where the fed back coarse particles again undergo micropulverization. The pulverized product thus produced by this micropulverizer comprises particles in a very narrow range of particle size of micron order.

In this micropulverizer also, similarly as in the preceding example illustrated in FIG. 10, not only can the exhaust air temperature be kept low by cooling the aspirated intake air, but local rises in temperature of the stator 6 can be supressed, which was not possible in the known pulverizer. For this reason, even particles of low softening point can be smoothly pulverized without trouble, and even particles with low heat resistance can be pulverized without problems such as change or deterioration due to heat. Since this cooling of the intake air and the cooling of the stator is accomplished by a single cooling system, the cooling efficiency is high, and the operational cost is low.

Figure 12:
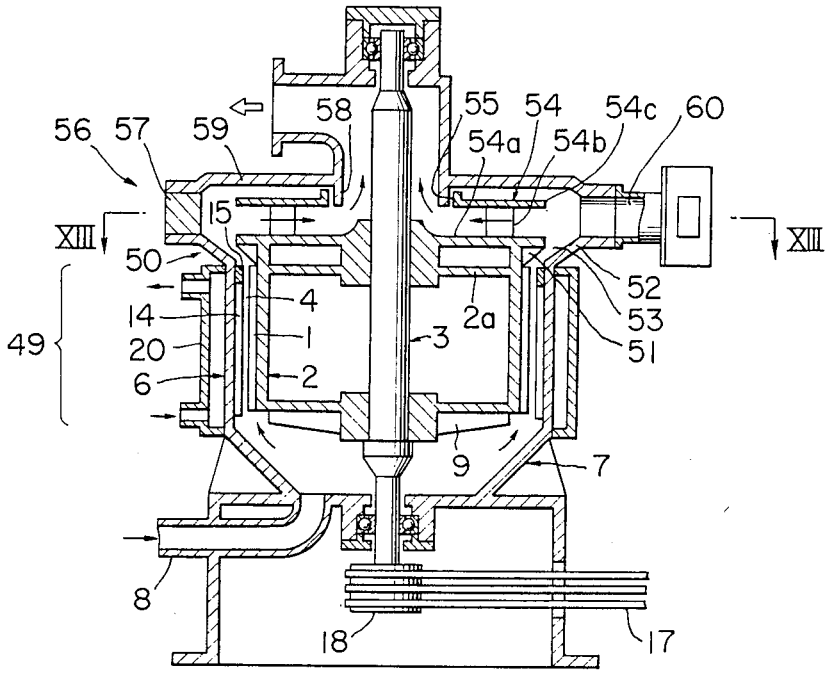
FIG. 12 is a view similar to FIGS. 1 and 7, showing still another example of the micropulverizer, in which a dispersing part and a classification section are provided in the casing above the rotor.

Still another embodiment of this invention as shown in FIG. 12 corresponds to a micropulverizer as illustrated in FIG. 7 in the upper part of which improvements have been made. Those parts and members in this micropulverizer shown in FIG. 12 which are the same or equivalent to corresponding parts in FIG. 7 are designated by like reference numerals. Detailed description of such parts will not be repeated, and only the differences between the two micropulverizers are described below.

In the instant micropulverizer shown in FIG. 12, a part 50 for dispersing pulverized particles is provided above the pulverization zone 49 corresponding to the pulverization chamber. This dispersing part 50 comprises centrifugal vanes 51 fixed to the outer periphery of the upper part of the rotor 2 and a casing part 52 of inverted frustoconical shape formed at the upper end of the stator 6 in a manner to confront the centrifugal vanes 51. Between the casing part 52 and the vanes 51 is formed a ring-shaped passage 53 directed radially outward or flared in the upward direction. The centrifugal vanes 51 project radially, and each vane is of triangular shape with its free edge extending progressively and radially outward from its lower part to its upper part. The rotor 2 at its upper part has a disk plate 2*a* perpendicular to the axis of the rotor, and spaced apart above this disk plate 2*a* is fixedly and coaxially disposed a larger disk 54*a* constituting a top end plate of the rotor 2. The centrifugal vanes are provided between the disk plate 2*a* and the disk 54*a* and are fixed to the outer peripheral edge of the disk 54*a*.

Figure 13:
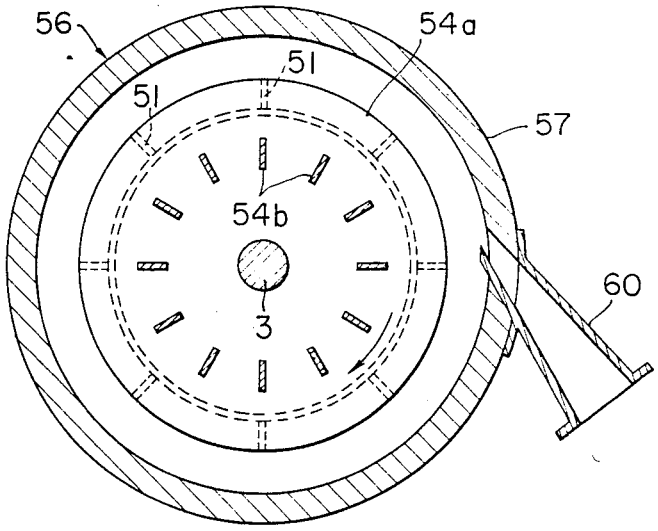
FIG. 13 is a horizontal sectional view taken along the plane indicated by line XIII—XIII in FIG. 12 as viewed in the direction of the arrow.

Contiguously above the pulverized particle dispersing part 50 is provided a pulverized particle classification section 56. This classification section 56 comprises: a classifying rotor 54 mounted coaxially on the above mentioned disk 54*a* and having a central through hole 55; a classification casing 57 formed contiguously to and above the inverted frustoconical casing part 52 around the classifying rotor 54 and having a coarse particle discharge outlet 60 (FIG. 13) orientated in the tangential direction with respect to the rotational direction of the rotor 2; and a top cover casing 59 covering the upper part of the classification casing 57 and having a fine particle discharge outlet 58 with a central downwardly directed skirt part fitted in the central through hole 55 of the classifying rotor 54 in a manner permitting rotation of the classifying rotor 54.

The classifying rotor 54 is constituted by the above described disk 54*a* at the upper part of the centrifugal vanes 51, a large number (12 in the instant example) of classifying plates 54*b* aligned in radial directions and spaced at equal angular intervals on this disk 54*a*, and a classifying disk 54*c* fixed to the upper edges of the classifying plates 54*b* and having at its center the above mentioned through hole 55.

The micropulverization action in the pulverization zone 49 or pulverization chamber of the above described micropulverizer is the same as that described hereinbefore with reference to FIG. 6, and, with respect to the pulverization zone 49, cooling by means of a cooling jacket is carried out similarly as in the example illustrated in FIG. 7.

The micropulverizer described above with reference to FIGS. 12 and 13 operates in the following manner. The pulverized particles of sizes ranging from micron order to a size between 10 and 20 microns which have passed through the pulverization chamber in the zone 49 are dispersed well, without agglomerating, by the high-speed rotation of the centrifugal vanes 51 and, riding on the outwardly revolving air current along the inner surface of the inverted frustoconical casing part 52, are conveyed to the inner surface of the classification casing 57. Of these pulverized particles, the micron order fine particles which have been adhering to the relatively coarse particles of sizes from 10 to 20 microns are separated at an intermediate part of their travel toward the interior of the classification casing 57 by the high-speed rotation of the centrifugal vanes 51.

Figure 14:
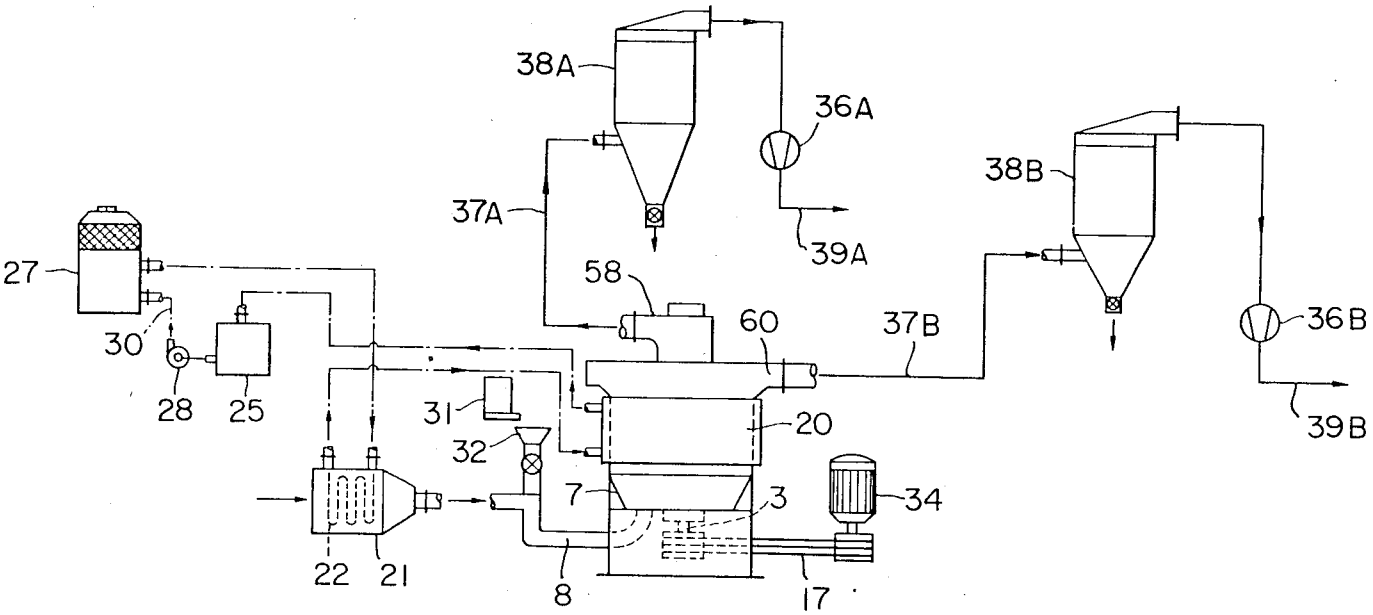
FIG. 14 is a schematic flow diagram similar to FIGS. 10 and 11, showing a pulverizing apparatus having the micropulverizer shown in FIG. 12 as the principal component.

Then, riding on the inwardly revolving air current caused by the classifying rotor 54 rotating at high speed, the puvlerized particles are carried to the inner side of the classifying rotor 54, by which they are classified, and only fine particles of micron order pass between the classifying plates 54*b* and are discharged together with an air stream through the fine particle discharge outlet 58. As shown in FIG. 14, the fine particles and the air stream thus discharged pass through a discharge pipe 37A and enter a bag filter 38A, by which the fine particles are separated from the air, which is drawn by an exhaust fan 36A and exhausted through an exhaust pipe 39A. The fine particles caught in the bag filter 38A are transferred as a finely pulverized product to storage means (not shown).

On the other hand, the relatively coarse particles classified by the classifying rotor 54 as described above are flung by the classifying plates 54*b* and, rotating in the rotating direction of the classifying rotor 54 along the inner surface of the classification casing 57, are discharged together with air through the coarse particle discharge outlet 60. The relatively coarse particles and the air then pass through a discharge pipe 37B and enter a bag filter 38B, where the coarse particles are separated from the air, which is drawn by an exhaust fan 36B and exhausted through an exhaust pipe 39B. The coarse particles caught in the bag filter 38B are transferred to storage means (not shown).

Figure 15:
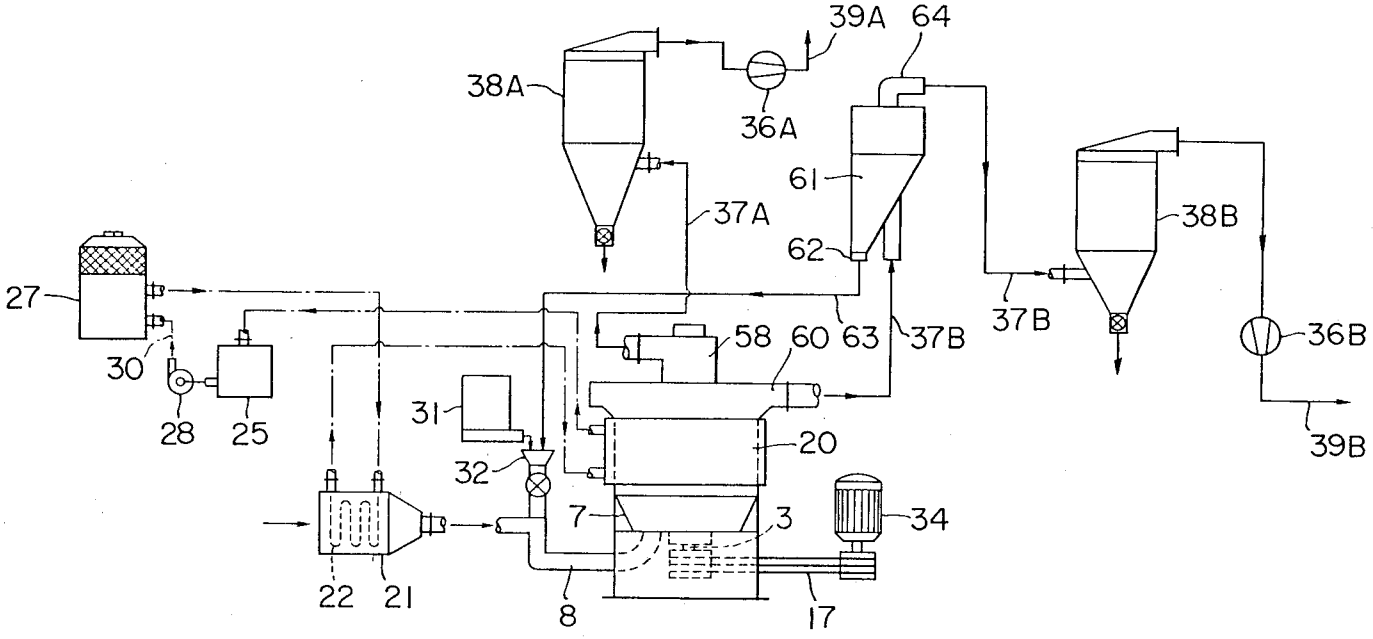
FIG. 15 is a schematic flow diagram similar to FIG. 14, showing a modification of the pulverizing apparatus illustrated in FIG. 14.

The micropulverizer illustrated in FIG. 14 can be modified as indicated in FIG. 15. In this modified micropulverizer, a classifier 61 is installed at an intermediate point in the discharge pipe 37B connecting the coarse particle discharge outlet 60 and the bag filter 38B. The coarse particle discharge outlet 62 of this classifier 61 is connected by a pipe line 63 to the aforedescribed particle material feed inlet 32, while the fine particle discharge outlet 64 is connected by the discharge pipe 37B to the bag filter 38B. In other respects, the parts and organization of this micropulverizer are the same as those of the micropulverizer shown in FIG. 14 and therefore will not be described in detail again.

In the operation of the instant micropulverizer shown in FIG. 15, the pulverized particles are classified in the pulverized particle classification section 56, and, together with an air stream, the relatively coarse particles and a portion of the fine particles are discharged through the coarse particle discharge outlet 60 and, passing through the discharge pipe 37B, enter the classifier 61, where the particles are classified into fine particles of micron order and relatively coarse particles of sizes between 10 and 20 microns. The fine particles are discharged through the fine particle discharge outlet of the classifier 61 and, passing through the discharge pipe 37B, are introduced into the bag filter 38B to be separated from the air as described hereinbefore. On the other hand, the relatively coarse particles are conveyed from the coarse particle discharge outlet 62 of the classifier 61, through the pipe line 63, and to the particle material feed inlet to be fed, together with newly fed particles to be pulverized, through the feed inlet 8 into the lower part 7 of the pulverizer casing and thereby to be repulverized in the pulverization chamber of the zone 49 (FIG. 12). Thus, in this micropulverizer, a micropulverized product consisting of only fine particles of a very narrow range of particle size of micron order, in which coarse particles of sizes of 10 to 20 microns are not included, is obtained.

A cooling jacket 20 is installed in the micropulverizer shown in FIG. 12 and in the modification thereof, but this cooling jacket may be omitted. In this case, while the performance in suppressing temperature rises will drop, the dispersing action in the part 50 for dispersing pulverized particles and the classifying action in the pulverized particle classification section 56 are exactly the same as those in the micropulverizer shown in FIG. 12.

Figure 16:
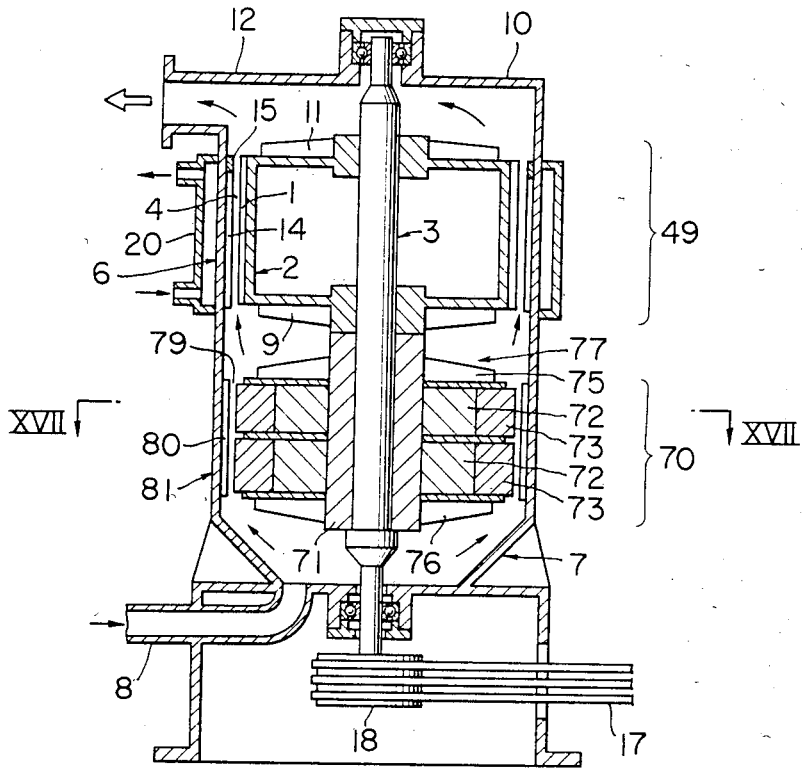
FIG. 16 is a view similar to FIG. 7, showing a further example of the micropulverizer, in which a coarse particle pulverization section is provided below the main rotor.

In all of the above described pulverizers, if large coarse particles are mixed with the particles to be pulverized, the rotor 2 or the stator 6 will be severely abraded by the collision of these large coarse particles thereagainst. For this reason, it is desirable that the particles to be fed into the pulverizer be prepulverized beforehand to particle sizes in a specific range prior to being fed, but this entails a great amount of troublesome work. This problem is solved in one embodiment of this invention as illustrated in FIG. 16.

In the micropulverizer shown in FIG. 16, a coarse particle pulverization section 70 is provided coaxially below the main rotor 2 on the same rotor shaft 3 and occupies the lower half of the cylindrical part of the pulverizer casing. The main rotor 2 occupies the upper half of the casing in the pulverization zone 49, in which the parts and construction are the same as those of the micropulverizer shown in FIG. 12 including a rotor 2 and a stator 6 which are exactly the same as those shown in FIGS. 1 and 2.

Figure 17:
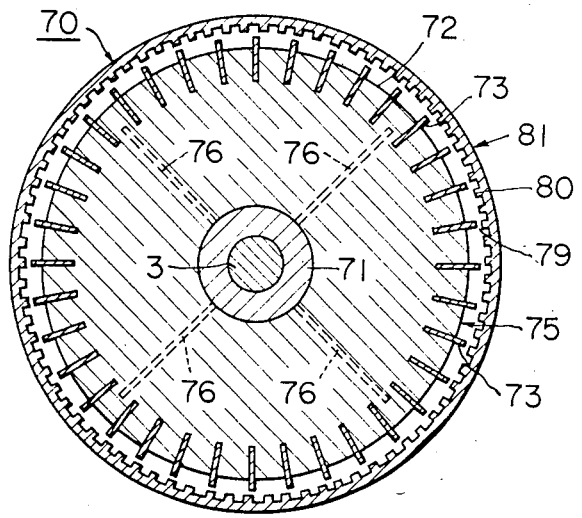
FIG. 17 is a horizontal sectional view taken along the plane indicated by line XVII—XVII in FIG. 16 as viewed in the direction of the arrow.

In the coarse particle pulverization section 70, upper and lower support members 72 of ring shape are fixed to and around a hub 71 fixed to and around the lower half of the shaft 3. The support members 72 respectively support along generatrices of their outer surfaces a large number of pulverizing teeth 73 extending radially outward as shown in FIG. 17. Upper and lower vanes 75 and 76 are provided respectively above the upper support member 72 and below the lower support member 72. The above described parts constitute the rotor 77 of the coarse particle pulverization section 70 provided with a stator 81 having around the inner wall surface thereof a large number of ridges 80 (FIG. 17) of rectangular profile in cross section. A constant gap 79 is provided between the crests of the ridges 80 and those of the pulverizing teeth 73.

Since the rotors 2 and 77 are fixedly supported on the common shaft 3, they are rotated unitarily. A product discharge outlet 12 is provided at the top of the upper part 10 of the casing similarly as in the micropulverizer shown in FIG. 1.

The operation of the micropulverizer of the instant example of the above described construction is started similarly as in the case of the micropulverizer shown in FIG. 10 by rotating the rotor shaft 3 at high speed, starting the exhaust fan, and operating the cooling system. Then, together with aspirated air cooled to a low temperature of 0° to 5° C., particles to be pulverized are fed through the feed inlet 8 into the lower part 7 of the casing. These particles are then swept by the air stream generated by the lower vanes 76 below the rotor 77 and rise along the inner surface of inverted frustoconical shape of the casing lower part 7 to enter the pulverization chamber formed between the rotor 77 and the stator 81, where the large particles are pulverized.

Then, after being pulverized to particle sizes in a certain range, the particles leave the upper end of the pulverization chamber and, riding on the air stream created by the upper vanes 75 and the agitation vanes 9 of the upper rotor 2, are introduced into the pulverization chamber formed between the rotor 2 and the stator 6. In this upper pulverization chamber, all of the particles are subjected to micropulverization similarly as in the preceding examples and, becoming a micropulverized product of a narrow particle size range of from micron order to sizes from 10 to 20 microns, are sent into the interior of the upper part 10 of the casing. These particles are then caused to revolve around and along the inner cylindrical surface of this upper casing part 10 by the centrifugal vanes 11 rotating at high speed and are discharged, together with air, through the product discharge outlet 12.

In the instant embodiment, also, the cooling jacket 20 may be omitted. The micropulverizer of this embodiment of the invention can be used by connecting it to ancillary components as shown in FIG. 10 or in FIG. 11.

Figure 18:
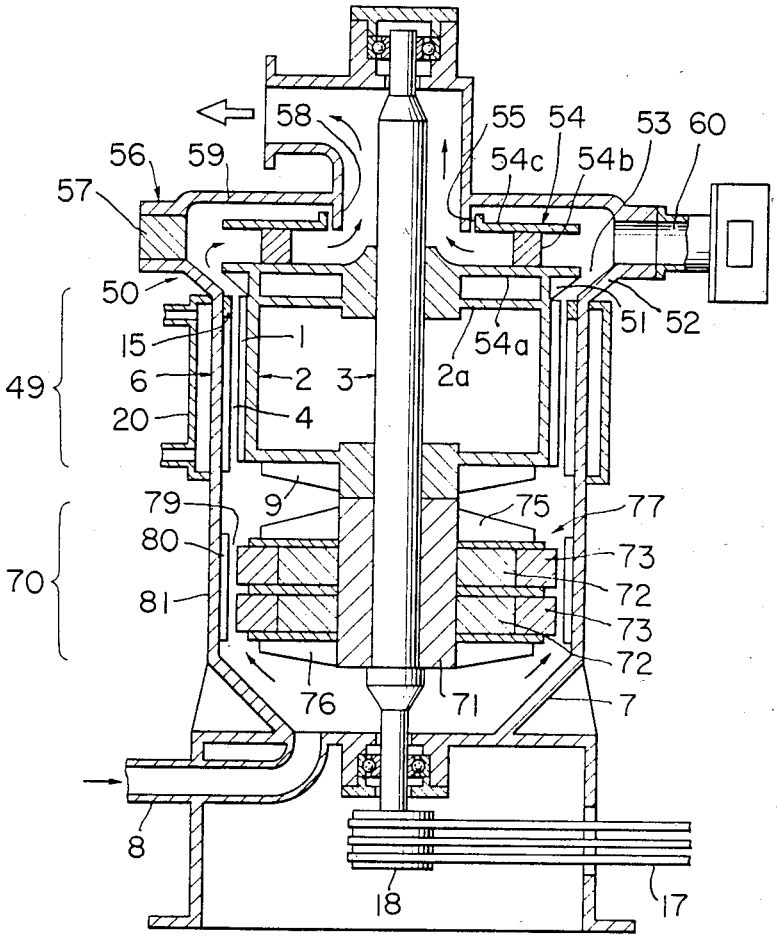
FIG. 18 is a view similar to FIG. 16, showing an additional example of the micropulverizer, in which a dispersing part and a classification section are provided above the main rotor of the micropulverizer shown in FIG. 16.
Figure 19:
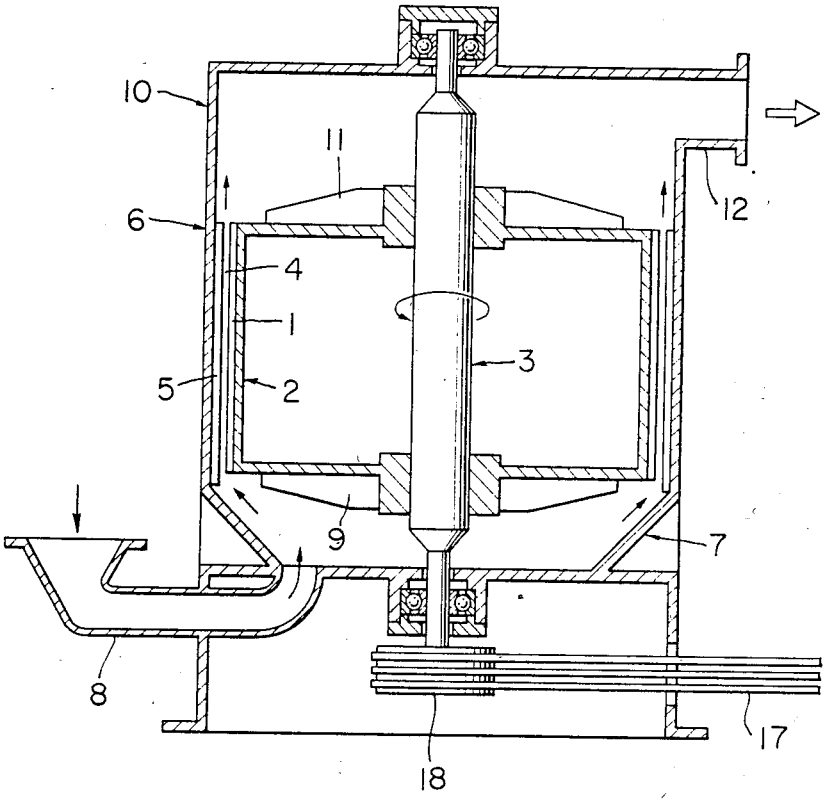
FIG. 19 PRIOR ART
FIG. 19 is an elevational view similar to FIG. 1, but showing an example of a conventional pulverizer.
Figure 20:
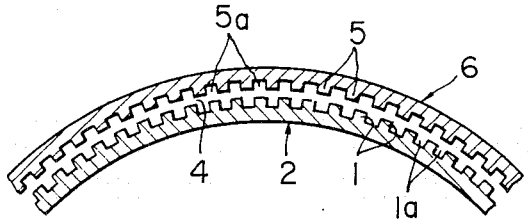
FIG. 20 PRIOR ART
FIGS. 20 and 21 are fragmentary plan views similar to FIG. 2 showing features of the conventional pulverizer.

In a further embodiment of this invention as shown in FIG. 18, a coarse particle pulverization section 70 is provided in the lower half of the casing, and a fine particle pulverization section 49 is provided in the upper half of the casing similarly as in the embodiment shown in FIG. 16. This embodiment differs from that in FIG. 16 in that a part 50 for dispersing pulverized particles and a pulverized particle classification section 56 are provided contiguously above the fine particle pulverization section 49 similarly as in the embodiment illustrated in FIG. 12. The construction, operation, and effective action of the dispersing part 50 and the classification section 56 are the same as those described hereinbefore in conjunction with FIG. 12. In the case of the embodiment shown in FIG. 18, also, the micropulverizer can be used by connecting ancillary components thereto as shown in FIG. 14 or in FIG. 15. Furthermore, in this embodiment, also, the cooling jacket 20 may be omitted.

What is claimed is:

1. In a pulverizer comprising a generally cylindrical vertically extending casing with a vertically extending axis, a top and a bottom, having at the bottom thereof a feed inlet for particles to be pulverized and air conveying the particles and having at the top thereof a pulverized product discharge outlet, a rotor having a generally cylindrical outer surface and being rotatably supported within the casing by a vertically extending rotating shaft having an axis, said rotor having along generatrices of said outer surface thereof a large number of vertical ridges, and a stator provided around an inner wall surface of the casing and having along generatrices of said inner wall surface a large number of vertically extending ridges confronting the ridges of the rotor with a gap between said ridges of said stator and said ridges of said rotor, said ridges of the stator making relative movement with respect to said ridges of said rotor as said rotor is rotated around said rotating shaft, the improvement wherein:

said gap is no greater than 1 mm;

said ridges of said stator are of sawtooth shape as viewed in cross section, each ridge of said stator having a leading flank and a trailing flank with respect to the relative movement between said rotor and said stator so that said trailing flank of one ridge of said stator is opposite to said leading flank of a ridge immediately adjoining said one ridge in the direction of said relative movement, said trailing flank lying in a vertical extending plane passing substantially through said axis of said shaft and forms an acute dihedral angle of 45 to 60 degrees with the opposite leading flank of said immediately adjoining ridge, thereby defining a trough of triangular cross section between said trailing flank of said one ridge and said leading flank of said immediately adjoining ridge, said leading flank lying in a vertically extending plane that is substantially tangential to said outer surface of said rotor; and at least one tier of a classification ring provided around said inner wall surface of said stator forming flow-blocking barriers across at least some of said troughs.

2. A pulverizer according to claim 1, wherein said clasification ring is provided at an intermediate height level of said stator adjacent upper portions of said ridges thereof.

3. A pulverizer according to claim 1, wherein said classification ring is provided at upper ends of said stator ridges.

4. A pulverizer according to claim 1, further comprising a cooling jacket installed around an outer surface of said stator.

5. A pulverizer according to claim 4, further comprising an air cooler having a cooling coil for cooling air drawn into the pulverizer through said feed inlet of said casing connected to said feed inlet via an inlet pipe, to an intermediate part of which is connected a particle material feed inlet for receiving particle material to be pulverized from a feeder, and a refrigeration system including a refrigeration machine provided to supply a refrigerant through said cooling coil and said cooling jacket.

6. A pulverizer according to claim 1, wherein an inlet of a particle classifier having a coarse particle discharge outlet and a fine particle discharge outlet is connected to said pulverized product outlet of the pulverizer, said fine particle discharge outlet being connected to a bag filter, said coarse particle discharge outlet being connected to a bag filter, and said coarse particle discharge outlet being connected to said feed inlet of the pulverizer casing.

7. A pulverizer according to claim 1, further comprising: (a) a pulverized particle dispensing part comprising centrifugal vanes provided around the outer periphery of an upper portion of said rotor and a casing of inverted frustoconical shape provided an upper end of said stator in confronting relation to said centrifugal vanes; and (b) a pulverized particle classification section positioned continuously above said pulverized particle dispersing part and comprising a classifying rotor provided above said centrifugal vanes and having a central through hole, a classification casing connected to an upper end of said inverted frustoconical casing in confronting relation to said classifying rotor and having a coarse particle discharge outlet, and a top cover casing secured onto an upper end of said classification casing and having a fine particle discharge outlet with a central downwardly directed skirt fitted in said central through hole of said classifying rotor.

8. A pulverizer according to claim 7, further comprising a cooling jacket installed around an outer surface of said stator.

9. A pulverizer according to claim 7, further comprising first and second bag filters respectively connected to said coarse particle discharge outlet and said fine particle discharge outlet, thereby to obtain relatively coarse particles and fine particles, respectively, as products.

10. A pulverizer according to claim 7, wherein said coarse particle discharge outlet of said classification casing is connected to an inlet of a classifier having a coarse particle discharge outlet connected to said feed inlet of the pulverizer and a fine particle discharge outlet connected to a first bag filter, and said fine particle discharge outlet of the pulverizer is connected to a second bag filter.

11. A pulverizer according to claim 1, further comprising a coarse particle pulverization section having a coarse pulverization gap provided within said casing at a position upstream, with respect to the flow of air and particles, of said gap between said ridges of said stator and said ridges of said rotor.

12. A pulverizer according to claim 11, further comprising a cooling jacket installed around an outer surface of said stator.

13. A pulverizer according to claim 11, wherein said coarse particle pulverization section comprises a second stator comprising a large number of ridges of rectangular cross section formed on said inner wall surface of said casing parallel to the casing axis and a second rotor adapted to rotate within said second stator and having around its outer peripheral surface a large number of pulverizing teeth orientated parallel to the casing axis.

14. A pulverizer according to claim 11, further comprising: (a) a pulverized particle dispersing part comprising centrifugal vanes provided around the outer periphery of an upper portion of said main rotor at a height level above said gap and a casing of inverted frustoconical shape provided on an upper end of said stator in confronting relation to said centrifugal vanes; and (b) a pulverized particle classification section positioned contiguously above said pulverized particle dispersing part and comprising a classifying rotor provided above said centrifugal vanes and having a central through hole, a classification casing connected to an upper end of said inverted frustoconical casing in confronting relation to said classifying rotor and having a coarse particle discharge outlet, and a top cover casing secured onto an upper end of said classification casing and having a fine particle discharge outlet with a central downwardly directed skirt fitted in said central through hole of said classifying rotor.

15. A pulverizer according to claim 14, further comprising a cooling jacket installed around an outer surface of said stator.

* * * * *